US005580375A

United States Patent [19]

Feldstein et al.

[11] Patent Number: 5,580,375

[45] Date of Patent: Dec. 3, 1996

[54] PRESTABILIZATION OF PARTICULATE MATTER PRIOR THE DISPERSION

[75] Inventors: Nathan Feldstein, Princeton, N.J.; Philip Dumas, Morrisville, Pa.

[73] Assignee: Surface Technology, Inc.

[21] Appl. No.: 382,709

[22] Filed: Feb. 2, 1995

Related U.S. Application Data

[63] Continuation of Ser. No. 77,665, Jun. 18, 1993, Pat. No. 5,389,229.

[51] Int. Cl.[6] ..... C23C 18/18; C23C 18/31

[52] U.S. Cl. ..... 106/1.05; 106/1.22; 106/1.25

[58] Field of Search ..... 106/1.05, 1.22, 106/1.25

[56] References Cited

U.S. PATENT DOCUMENTS

| | | | |
|---|---|---|---|
| 3,677,907 | 7/1972 | Brown et al. | 204/16 |
| 3,687,824 | 8/1972 | Brown et al. | 204/40 |
| 4,278,712 | 7/1981 | Thomann | 106/1.11 |
| 4,495,216 | 1/1985 | Soerensen et al. | 106/1.11 |
| 4,716,059 | 12/1987 | Kim | 106/1.23 |
| 5,145,517 | 9/1992 | Feldstein et al. | 106/1.27 |
| 5,300,330 | 4/1994 | Feldstein et al. | 106/1.23 |

*Primary Examiner*—Helene Klemanski

[57] ABSTRACT

Disclosed is a method for the plating of a substrate with a composite coating bearing a metallic matrix with finely divided particulate matter dispersed therein. The plating bath is derived by the admixing of a prestabilized particulate matter composition or a precursor thereof along with the required plating chemicals. The use of a prestabilized particulate matter composition offers a convenient way of shipping treated powders devoid of liquids and thereby minimizing shipping costs and aging effects commonly associated with liquid dispersions. The use of the novel prestabilized particulate matter composition along with the plating chemistry provides results substantially the same as those observed from freshly prepared liquid dispersions and their incorporation along with the plating chemicals.

4 Claims, No Drawings

PRESTABILIZATION OF PARTICULATE MATTER PRIOR THE DISPERSION

This is a continuation of application Ser. No. 08/077,665 filed Jun. 18, 1993 now U.S. Pat. No. 5,389,229.

BACKGROUND OF THE INVENTION

The plating of articles with composite coating bearing finely dispersed divided particulate matter is well documented. This technology has been widely practiced in the field of electroplating as well as electroless plating. The acceptance of such composite coating stems from the recognition that the inclusion of finely divided particulate matter within metallic matrices can significantly alter the properties of the coating with respect to properties such as wear resistance, corrosion resistance, appearance, and lubricity.

Electroless composite technology is a more recent development as compared to electrolytic composite technology. The state of the art in composite electroless plating is documented in a recent text entitled "Electroless Plating Fundamentals and Applications," edited by G. Mallory and J. B. Hadju, (1990) Chapter 11.

The evolution of composite electroless plating dates back to Oderkerken U.S. Pat. No. 3,614,183 in which a structure of composite electroless plating with finely divided aluminum oxide was interposed between electrodeposited layers to improve the corrosion resistance. Thereafter, Metzger et al, U.S. Pat. No. 3,617,363 and U.S. Pat. No. 3,753,667 extended the Oderkerken work to a great variety of particles and miscellaneous electroless plating baths. Thereafter, Christini et al in U.S. Pat. No. Re. 33,767 further extended the composite electroless plating to the codeposition of diamond particles. In addition, Christini et al demonstrated certain advantages associated with the deposition of the barrier layer (strike) prior to the composite layer. Yano et al in U.S Pat. No. 4,666,786 examined the inclusion of silicon carbide along with boron nitride for achieving improved wear and sliding properties. Feldstein in U.S. Pat. Nos. 4,358,922 and 4,358,923 demonstrated the advantages of utilizing a metallic layer above the composite layer. The overlayer is essentially free of any particulate matter. Spencer in U.S. Pat. No. 4,547,407 demonstrated the utilizing of a mixture of dual sized particles in achieving improved smoothness of coating. Feldstein et al in U.S. Pat. Nos. 4,997,686 and 5,145,517 demonstrated utilization of particulate matter stabilizers in the deposition of uniform stable composite electroless plating. Parker in U.S. Pat. No. 3,723,078 demonstrated the codeposition of refractory metals and chromium along with composite electroless plating. Helle et al in U.S. Pat. Nos. 4,098,654 and 4,302,374 have explored special compositions in the preparation of stabilized PTFE dispersions and their subsequent utilization in electrolytic plating.

Review of the examples of Helle et al demonstrate the great sensitivity in securing highly stabilized dispersions for the PTFE and their incorporation thereafter in the presence in strong electrolytes normally present in the electroplating baths.

Others have utilized dispersions of silicon carbide and other particulate matters and incorporated the prepared dispersions into metallizing plating compositions. It has been recognized that regardless of the best effort in securing the optimum dispersions, aging effects will lead to the deterioration of the dispersions with its storage due to thermal, gravimetric, and agitation effects. These conditions lead to precipitation and/or agglomeration of particles within the prepared dispersions. Accordingly, it is highly desirable to prepare a source for the dispersed particles which will have a greater stability and could be used readily when incorporated into the plating compositions and/or a dispersion.

In the present invention it has been found that dispersed phases of particulate matter used in the plating processes can be prepared in a paste or dried form (powder) which can be incorporated thereafter directly or indirectly into the plating composition without any losses in performance thereafter. The materials derived from the paste and/or dried materials are readily dissolved and dispersed within the plating compositions, or can be made through an intermediate dispersion precursor.

The expression "prestabilized particulate matter composition" encompasses a state (composition) of matter which is substantially devoid of any solvent typically used in the preparation of a dispersion (e.g., water).

Such state can be in the form of powders, gels, and the like having a high viscosity with limited fluidity.

Prior to its use the prestabilized particulate matter composition is added directly to either the plating bath or is mixed with water to yield a dispersion and thereafter to the plating bath.

The following examples are provided in order to demonstrate the novelty of the present invention. It is noted that the invention is not limited to the scope of the examples, particularly as to the nature of the particles and/or plating bath composition used, but rather to the invention as a whole as taught and claimed.

EXAMPLE 1

A Ni-Slip (product of Surface Technology, Inc., Trenton, N.J.) dispersion comprising of PTFE particles in the range of 0.2 to 0.3 micron in size and having 60% by weight solid was allowed to dry using a roto-vac. Thereafter the dried product was transferred to a vacuum oven for further drying at 60° C. for several hours. The final product appeared to be a dried product. Of the final dried powder, 20 gr were placed in 15 ml of distilled and mixed on a magnetic stirrer for about 1-hour. At this point the resulting dispersion appeared visually the same as the original Ni-Slip dispersion which was the starting point. Thereafter, 3 ml of the reconstituted dispersion was added to 1-liter of an electroless plating bath, NiKlad 795 (sold by Allied-Kelite). Steel coupons plated in the final plating bath along with the added reconstituted product produced good results with no major difference(s) in comparison to same which was derived from a freshly prepared Ni-Slip dispersion. Accordingly, there appears to be no hystersis effect(s) in transforming the dispersion into the intermediate prestabilized composition state, i.e., the powder form.

EXAMPLE 2

The procedure use in Example 1 was repeated using a commercially sold PTFE dispersion under the name of Ni-Flor. Results and conclusions were same as those of Example 1.

EXAMPLE 3

The procedure used in Example 1 was repeated employing a commercial Teflon dispersion, Enlube Dispersion #1, sold by Enthone-OMI, Inc. Results and conclusions were same as in those of Example 1.

EXAMPLE 4

A commercial dispersion of silicon carbide sold by Japan Kanigan was evaluated in the spirit of the present invention. The aqueous dispersion provided a negative Zeta potential.

6.0 gr/100 ml of electroless plating bath were incorporated and a standard coupon was plated, and in parallel an equivalent amount was dried. Thereafter it was incorporated into the electroless plating bath in the same concentration as above and a test coupon was plated.

Both coupons visually appeared to be the same and a cross section showed the density of the particles to be approximately the same.

Therefore, it appears that the concept of the present invention is applicable to silicon carbide, a well known and typical wear-resistant particle.

EXAMPLE 5

A commercial boron-nitride dispersion sold under the name of BN-A (by Okuno Company, Osaka, Japan) was evaluated. Results and conclusions for the dried product vs. the fresh dispersion along with the final plating are the same.

EXAMPLE 6

In this example silicon carbide sold as Microgrit 1200 was used. The starting dispersion was prepared as follows:

10 grams of silicon carbide 90 grams of water 0.1 grams of Tamol (a surfactant sold by the Rohm & Haas Company, Philadelphia, Pa.)

Of the above, ½ was dried to a powder form at 80° C. and vacuum. Using an electroless nickel plating bath (CDC sold by Surface Technology, Inc., Trenton, N.J.) test coupons were plated using the same equivalent concentration of silicon carbide either from the original liquid dispersion or using the intermediate dried powder. The results in both cases showed the same plating rate and concentration of the silicon carbide within the deposit.

We claim:

1. A prestabilized composition having a limited fluidity for use in the preparation of a liquid-solid dispersion, said composition comprising of insoluble particulate matter and a dispersant; said dispersion formed from the admixing of said composition with a liquid.

2. The composition according to claim 1 wherein said composition is prepared by the dehydration of a dispersion to yield said composition having a limited fluidity.

3. A prestabilized composition having limited fluidity for use in coating an article, said composition comprising insoluble particulate matter, a dispersant for said particulate matter when said composition is reconstituted into a fluid state.

4. A method for the preparation of a dispersion comprising a solvent, a dispersant and insoluble particulate matter; said dispersion is derived from the admixing of a prestabilized composition comprising a solvent, said prestabilized composition comprising insoluble particulate matter and a dispersant.

* * * * *